US009821969B2

(12) United States Patent
Nagai et al.

(10) Patent No.: US 9,821,969 B2
(45) Date of Patent: Nov. 21, 2017

(54) PAPER CASE AND PAPER FEED SYSTEM

(71) Applicant: SEIKO EPSON CORPORATION, Tokyo (JP)

(72) Inventors: Yoshikazu Nagai, Nagano (JP); Koichi Kikuchi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/228,065

(22) Filed: Aug. 4, 2016

(65) Prior Publication Data

US 2017/0043968 A1 Feb. 16, 2017

(30) Foreign Application Priority Data

Aug. 11, 2015 (JP) ..... 2015-159192

(51) Int. Cl.
*B65H 1/06* (2006.01)
*B65H 1/26* (2006.01)

(52) U.S. Cl.
CPC ..... *B65H 1/266* (2013.01); *B65H 1/06* (2013.01); *B65H 2402/46* (2013.01); *B65H 2404/743* (2013.01); *B65H 2405/115* (2013.01); *B65H 2405/1136* (2013.01); *B65H 2405/15* (2013.01)

(58) Field of Classification Search
CPC ..... B65H 1/06; B65H 1/04; B65H 2405/115; B65H 2405/15
See application file for complete search history.

(56) References Cited

U.S. PATENT DOCUMENTS 5,222,722 A * 6/1993 Kamano ..... B41J 11/58 271/145
6,308,947 B1 * 10/2001 Kojima ..... B65H 3/0661 271/124
2003/0047862 A1 * 3/2003 Komatsu ..... B65H 5/062 271/10.01
2008/0246211 A1 * 10/2008 Romanoff ..... B65H 1/00 271/145
2008/0259414 A1 10/2008 Kitagawa et al.
2012/0248687 A1 * 10/2012 Takahata ..... B65H 3/063 271/253

FOREIGN PATENT DOCUMENTS

JP 58069647 A * 4/1983
JP 63272727 A * 11/1988
JP 2008-270954 A 11/2008
JP 2014214018 A * 11/2014

* cited by examiner

*Primary Examiner* — Luis A Gonzalez
(74) *Attorney, Agent, or Firm* — Global IP Counselors, LLP

(57) ABSTRACT

A paper case includes a paper ejection opening, side walls, and a front wall. When the paper case is mounted on a paper stand, the paper ejection opening is positioned at a front end facing a downstream side. In addition, the side walls are positioned on a first side and a second side in a direction intersecting a transport route and each have a height relative to the paper stand greater than a height of the paper feed opening relative to the paper stand. Furthermore, the front wall continues from the front end and slopes so that a height of the front wall relative to the paper stand increases toward an upstream side of the transport route.

11 Claims, 8 Drawing Sheets

PAPER CASE AND PAPER FEED SYSTEM

CROSS REFERENCES TO RELATED APPLICATIONS

The entire disclosure of Japanese Patent Application No. 2015-159192, filed Aug. 11, 2015 is incorporated by reference herein.

BACKGROUND

1. Technical Field

The present invention relates to a paper case and a paper feed system.

2. Related Art

Some scanners known in the art are equipped with an automatic paper feed device, usually called an ADF (auto document feeder) (e.g., refer to JP-A-2008-270954). An ADF sequentially transports paper sheets stacked on a paper stand (paper feed tray) to a scanner one by one. Then, the scanner sequentially scans these paper sheets.

Only several tens of paper sheets can be placed in an ADF at a time. So, when a scanner scans a large number of photo paper sheets in order to store them in an electronic data format, for example, a user has to repeatedly place paper sheets in the ADF until all the paper sheets have been scanned. This process may be laborious for the user. A disadvantage may also lie in other apparatuses equipped with an ADF. Therefore, there is a market demand for a larger number of paper sheets (e.g., several hundreds to several thousands of paper sheets) to be placed in an ADF at a time.

SUMMARY

An advantage of some aspects of the invention is that a paper case and a paper feed system can provide a user with excellent usability.

According to an aspect of the invention, a paper case can accommodate a paper sheet and is to be installed in a transport apparatus having a transport mechanism. The transport mechanism transports a paper sheet placed on a paper stand from a paper feed opening to a downstream side of a transport route. The paper case includes a paper ejection opening, a plurality of side walls, and a front wall. When the paper case is mounted on the paper stand, the paper ejection opening is positioned at a front end facing the downstream side. In addition, the side walls are positioned on a first side and a second side in a direction intersecting the transport route, and a height of each side wall relative to the paper stand is greater than a height of the paper feed opening relative to the paper stand. Furthermore, the front wall continues from the front end and slopes so that a height of the front wall relative to the paper stand increases toward an upstream side of the transport route.

With the foregoing configuration, the paper case can accommodate a larger number of paper sheets than the maximum number of paper sheets that may be directly placed on the paper stand and transported to the interior of the transport apparatus through the paper feed opening. In addition, the paper case can easily guide the paper sheets to the interior of the transport apparatus through the paper ejection opening and the paper feed opening. Consequently, it is possible to reduce the burden on the user when the transport mechanism transports a large number of paper sheets.

In the aspect of the invention, when the paper case is mounted on the paper stand, a height of the paper ejection opening relative to the paper stand is preferably lower than the height of the paper feed opening relative to the paper stand, and the front end is preferably inserted into the transport apparatus through the paper feed opening.

With the foregoing configuration, by inserting the front end into the transport apparatus through the paper feed opening, the paper sheet can be reliably guided from the paper case to the interior of the transport apparatus through the paper feed opening.

In the aspect of the invention, the paper case preferably further includes an upper cover that is switched between a closed state and an open state; in the closed state, the upper cover closes an upper opening defined by upper ends of the side walls on the first side and the second side and an upper end of the front wall, and in the open state, the upper cover is moved upward from the upper opening to open the upper opening.

With the foregoing configuration, by setting the upper cover to the open state, the paper sheet can be easily accommodated in the paper case, and the capacity of the paper case can be increased (a larger number of paper sheets can be accommodated in the paper case).

In the aspect of the invention, the paper case preferably further includes a positioning mechanism that, when the paper case is mounted on the paper stand, positions the paper case by making contact with the transport apparatus on the upstream side.

With the foregoing configuration, the location of the paper case and the location of the paper sheet in the paper case can be easily controlled along the transport route.

In the aspect of the invention, the paper case preferably further includes a recess at the front end. When the paper case is mounted on the paper stand, the recess creates a clearance for a sensor disposed adjacent to the paper feed opening; the sensor is used to detect whether the paper sheet is present.

The foregoing configuration can reduce the risk of the sensor falsely detecting the presence of a paper sheet, which is attributed to accidental contact between the sensor and the front end (a portion of the front end around the paper ejection opening) in the paper case.

In the aspect of the invention, at least a portion of inner surfaces of the side walls on the first side and the second side, an inner surface of the front wall, and an inner surface of a bottom that makes contact with the paper stand on which the paper case is mounted preferably has a lower frictional coefficient than outer surfaces of the side walls, an outer surface of the front wall, and an outer surface of the bottom.

With the foregoing configuration, the paper sheet can be ejected smoothly from the paper case through the paper ejection opening.

In the aspect of the invention, the paper case preferably includes a front cover that can at least partly close the paper ejection opening.

The foregoing configuration can close the paper ejection opening with the front cover. Therefore, it is possible to reduce the risk of the paper sheet accidentally being ejected from the paper case through the paper ejection opening when the paper case is mounted on the paper stand.

In the aspect of the invention, the paper case further includes a rear wall that is positioned on the upstream side of the front wall when the paper case is mounted on the paper stand. The rear wall slopes so that a height of the rear wall relative to the paper stand increases toward the upstream side.

With the foregoing configuration, the downstream side of a stack of paper sheets in the paper case is controlled by the front wall while both the downstream side and the front wall slope at substantially the same angle. Likewise, the upstream side of the paper sheets is controlled by the rear wall while both the upstream side and the rear wall slope at substantially the same angle. As a result, the paper sheets placed at a lower location are positioned further ahead on the downstream side. Consequently, it is possible to smoothly guide the paper sheets in the paper case from the bottom to the interior of the transport mechanism through the paper feed opening.

In the aspect of the invention, the paper case preferably further includes a movable wall disposed therein. The movable wall is movable between the side walls on the first side and the second side.

With the foregoing configuration, the location of the paper sheet in the paper case can be easily controlled by the movable wall in a direction intersecting the transport route.

It should be noted that the technical ideas of the invention can be implemented by using various methods and products in addition to the paper case described above. As an example, the invention may be recognized as a paper feed system equipped with the above transport apparatus and paper case. As another example, the invention may be recognized as a paper feeding/transporting method using the above paper case and paper feed system and a method of producing a product, such as scanned data or printed material, through a feeding/transporting process.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
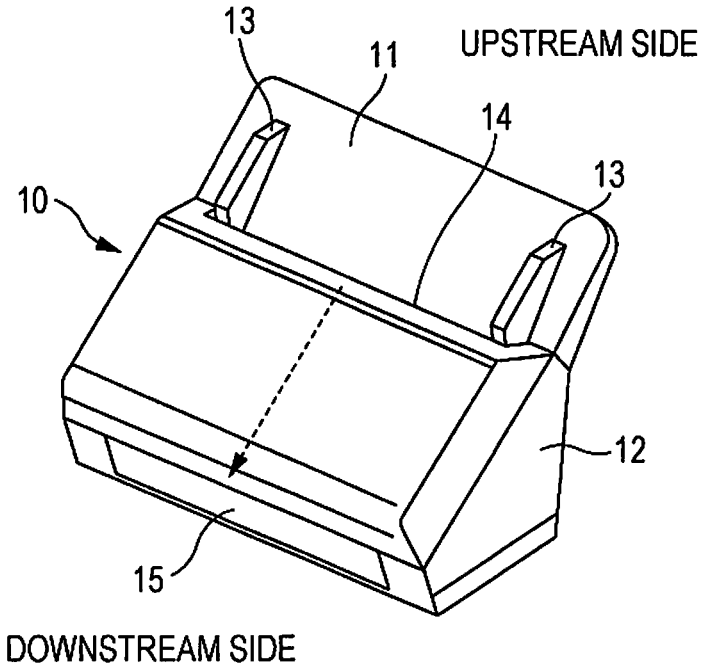
FIG. 1 is a perspective view of an exemplary scanner.

Some embodiments of the invention will be described below with reference to the accompanying drawings. It should be noted that the constituent elements illustrated in the drawings are examples for explaining the embodiments; therefore, a part of the constituent elements may be exaggerated or lack conformity for the purpose of illustration.

The term "transport apparatus" discussed herein refers to a general apparatus equipped with a transport mechanism that transports, along a transport route, paper sheets to be subjected to a predetermined process. Examples of such transport apparatuses include, but are not limited to, a scanner that scans paper sheets transported by a transport mechanism to create scanned data, a printer that prints data on paper sheets transported by a transport mechanism to produce printed materials, and a cutting machine that cuts paper sheets transported by a transport mechanism into a predetermined size. Furthermore, a transport apparatus may be an MFP (multifunction printer), which incorporates functions of a scanner, a printer, a facsimile, and other office machines into one. In the embodiments described below, an exemplary transport apparatus is implemented using a scanner.

First Embodiment

Figure 2A:
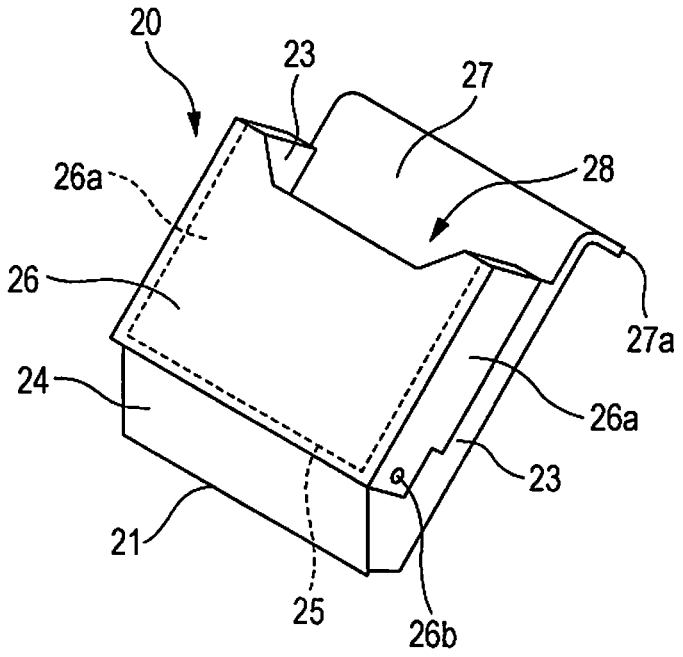
FIG. 2A is a perspective view of an exemplary paper case.
Figure 2B:
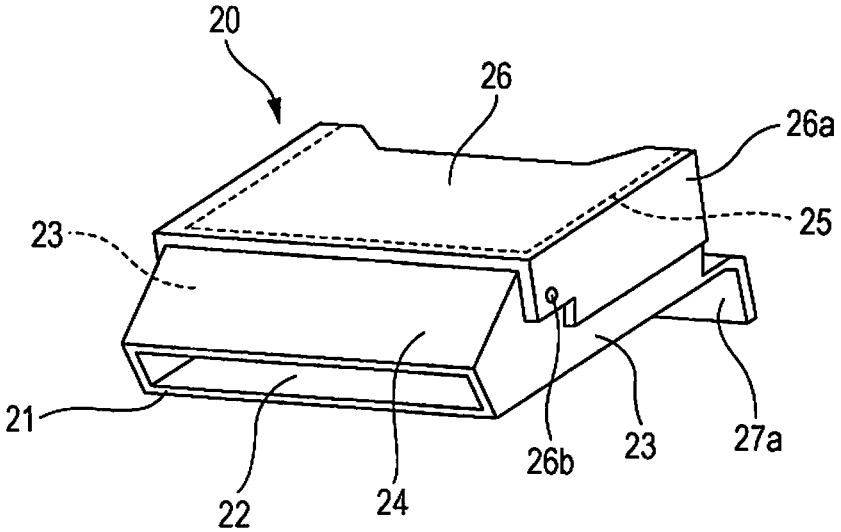
FIG. 2B is another perspective view of the paper case.
Figure 3A:
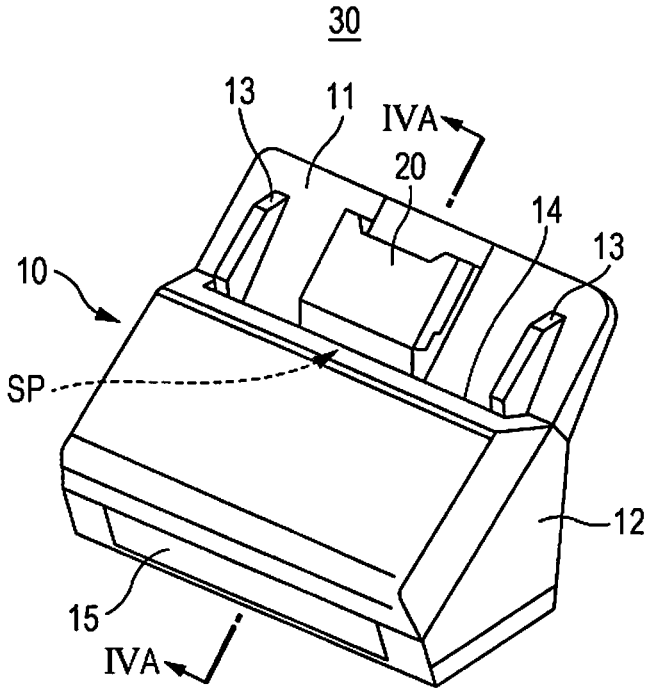
FIG. 3A is a perspective view of an exemplary state where the paper case is mounted on the paper stand of the scanner.
Figure 3B:
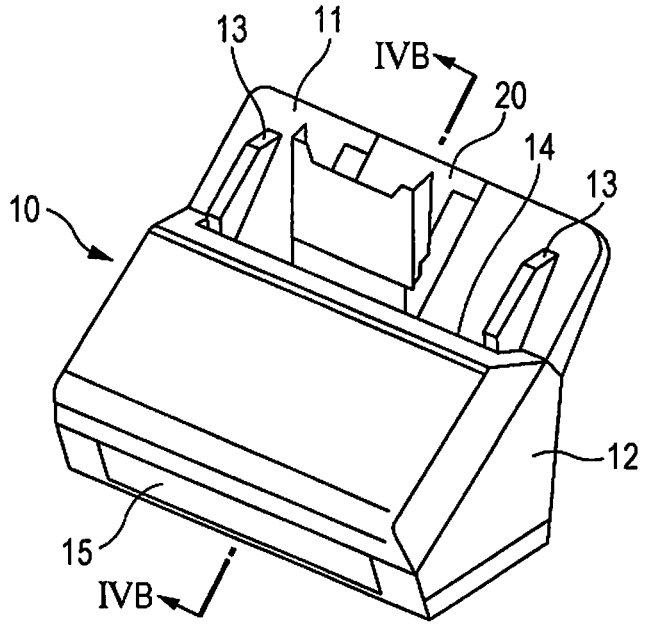
FIG. 3B is a perspective view of another exemplary state where the paper case is mounted on the paper stand of the scanner.

FIG. 1 illustrates a scanner 10 in perspective view. FIG. 2A and FIG. 2B illustrate a paper case 20 in perspective view from different viewpoints. FIG. 3A and FIG. 3B each illustrate a state where the paper case 20 is mounted on a paper stand of the scanner 10. In other words, FIG. 3A and FIG. 3B each illustrate a paper feed system 30 provided with the scanner 10 (transport apparatus) and the paper case 20.

The scanner 10 includes a paper stand 11 and a main body 12 as main components. As known in the art, a stack of paper sheets to be scanned can be placed on the paper stand 11. As illustrated in FIG. 1, the paper stand 11 slopes down from the rear of the scanner 10 to the front thereof. The main body 12 has a paper feed opening 14 on the rear side, which is closer to the paper stand 11 and has a paper ejection opening 15 on the front side, which is opposite to the rear side. The paper ejection opening 15 in the scanner 10 (the main body 12) is referred to below as the "main body paper ejection opening", for the purpose of avoiding confusion with a paper ejection opening 22 in the paper case 20 which will be described later.

As known in the art, a transport mechanism provided in the main body 12 functions as an ADF. More specifically, the transport mechanism sequentially takes in paper sheets placed on the paper stand 11 through the paper feed opening 14 while separating these paper sheets from one another by using a separation roller 16 provided close to the paper feed opening 14. Then, the transport mechanism transports the paper sheets to the downstream side of a transport route in the main body 12 and ejects the paper sheets to the outside through the main body paper ejection opening 15. In FIG. 1, the transport route in the main body 12 is denoted by the broken-line arrow. Herein, the term "downstream side" refers to the downstream side of the transport route; the term "upstream side" refers to the upstream side of the transport route.

As known in the art, the main body 12 has an image reader including a light source and a sensor at midway points on the transport route. The image reader reads information printed on the paper sheets transported along the transport route. In addition, the main body 12 can store image data received from the image reader and transmit the image data to a computer and other data processing devices.

The paper stand 11 has a pair of movable walls (sliders) 13, which are movable in directions intersecting (basically, perpendicular to) the transport direction; these intersecting directions correspond to the upper left direction and the lower right direction in FIG. 1, which will be referred to below as the width directions. Paper sheets having various sizes can be placed on the paper stand 11. A user can control the location of paper sheets on the paper stand 11 in a width direction by varying a distance between the movable walls 13 so as to make contact with the lateral sides of the paper sheets. Likewise, when the paper case 20 is mounted on the paper stand 11 as illustrated in FIG. 3A or FIG. 3B, the user can control the location of the paper case 20 by using the movable walls 13. Hereinafter, the movable walls 13 in the scanner 10 (the paper stand 11) are referred to as the "paper stand movable walls 13", for the purpose of avoiding confusion with movable walls 50 in the paper case 20 which will be described later.

As illustrated in FIG. 2A and FIG. 2B, the paper case 20 includes at least a front end 21, the paper ejection opening 22, side walls 23, and a front wall 24. The paper ejection opening 22 is formed at the front end 21. Each side wall 23 is connected to both lateral sides of the front end 21. The front wall 24 continues to the front end 21 while sloping down to the front end 21. Furthermore, the paper case 20 includes a bottom 27 and an upper cover 26. The bottom 27 is connected to both side walls 23 and a side of the front end 21 to which the front wall 24 is not connected. The upper cover 26 is formed opposite the bottom 27.

Hereinafter, for convenience of describing the structure of the paper case 20, the four sides of the paper case 20 will be mentioned below. A first side on which the front end 21 is formed is referred to as the front side; the second side opposite to the first side is referred to as the rear side; the third side on which the bottom 27 is formed is referred to as the lower side; and the fourth side on which the upper cover 26 is formed is referred to as the upper side. The surface of the paper case 20 on the rear side is provided with a rear opening 28. Basically, the user inserts paper sheets into the paper case 20 through the rear opening 28.

The upper cover 26 covers an upper opening 25, which is defined by the upper ends of the side walls 23 and the upper end of the front wall 24. The upper cover 26 has side covers 26*a*, which cover upper portions of the outer surfaces of the side walls 23. The side covers 26*a* of the upper cover 26 are supported, by a shaft 26*b*, at the location adjacent to the upper ends of the side walls 23 and the upper end of the front wall 24 so that the upper cover 26 is rotatable around the shaft 26*b*. The rotation enables the upper cover 26 to be switched between a closed state and an open state; in the closed state, the upper cover 26 covers the upper opening 25, and in the open state, the upper cover 26 is moved upward from the upper opening 25 to open the upper opening 25. In FIG. 2A, FIG. 2B, and FIG. 3A, the upper cover 26 is in the closed state; in FIG. 3B, the upper cover 26 is in the open state.

There is a limitation on the number of paper sheets that can be stacked on the paper stand 11. This is because when paper sheets are stacked on the paper stand 11, the downstream sides of these paper sheets are inserted into the main body 12 through the paper feed opening 14. Thus, the maximum number of paper sheets that can be placed on the paper stand 11 depends on the thickness of each paper sheet and the height (vertical dimension) of the paper feed opening 14. In this embodiment, the height of the paper feed opening 14 is defined by the distance between the paper stand 11 and the upper edge of the paper feed opening 14 in a direction normal to the surface of the paper stand 11. If photo paper sheets are scanned by the scanner 10 illustrated in FIG. 1 or FIG. 3A, for example, up to about 40 paper sheets can be placed on the paper stand 11 at a time. In contrast, the paper case 20 can accommodate 100 or more photo paper sheets (when the upper cover 26 is in the closed state). As is clear from this, the height of each side wall 23 in the paper case 20 and the height of the upper cover 26 in the closed state are greater than the height of the paper feed opening 14 and the height of each paper stand movable wall 13.

Figure 4A:
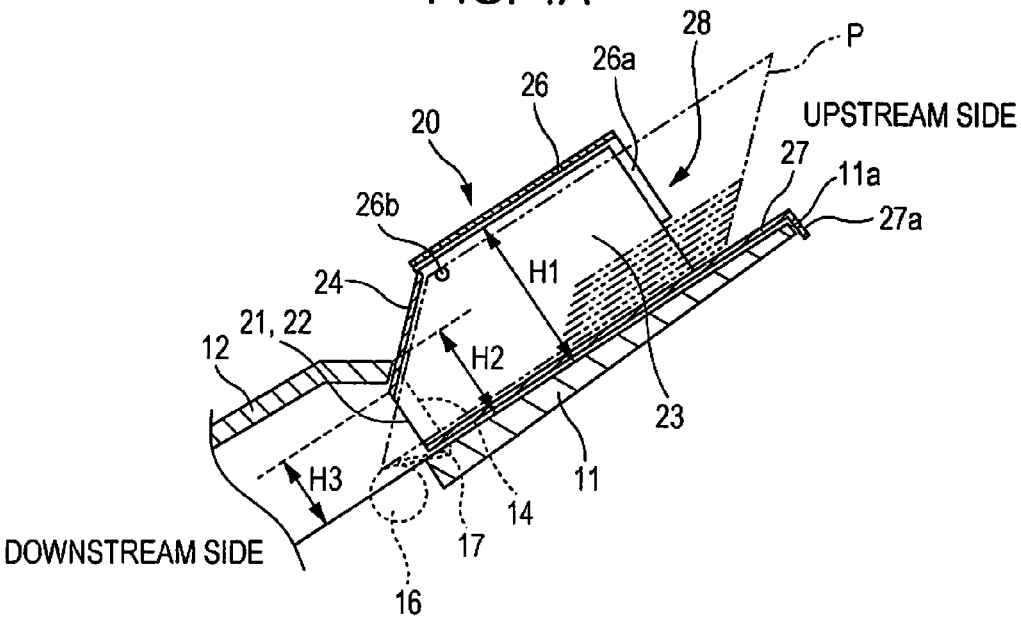
FIG. 4A is a cross-sectional view of an exemplary state where the paper case is mounted on the paper stand of the scanner.
Figure 4B:
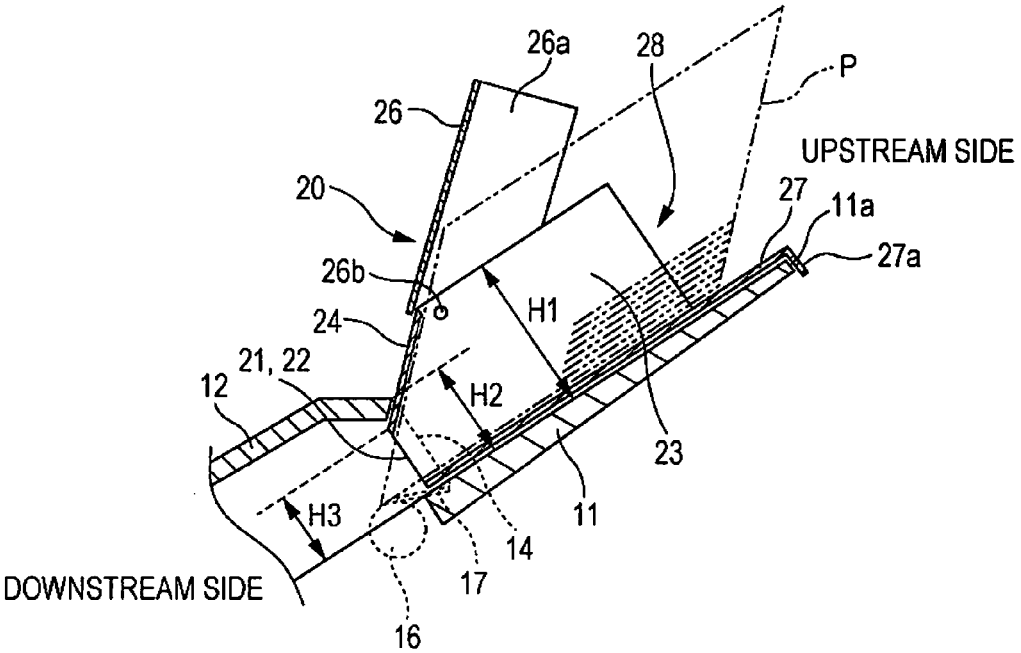
FIG. 4B is a cross-sectional view of another exemplary state where the paper case is mounted on the paper stand of the scanner.

FIG. 4A and FIG. 4B each illustrate the cross sections of the paper case 20 and the paper stand 11 in a simple manner when the paper case 20 is mounted on the paper stand 11 (the bottom 27 is in contact with the paper stand 11). Specifically, the cross sections of the paper case 20 and the paper stand 11 are taken in the transport direction and in a vertical direction of the plane of the paper stand 11 (taken along line IVA-IVA and IVB-IVB in FIG. 3A and FIG. 3B). In FIG. 4A, the upper cover 26 is in the closed state; in FIG. 4B, the upper cover 26 is in the open state. As can be seen from FIG. 4A and FIG. 4B, when the paper case 20 is mounted on the paper stand 11, the front end 21 is positioned on the downstream side, and the side walls 23 are positioned on both sides in a width direction. In this case, a height H1 of each side wall 23 relative to the paper stand 11 is greater than a height H2 of the paper feed opening 14 relative to the paper stand 11.

When the paper case 20 is mounted on the paper stand 11, the front wall 24 slopes up from the paper stand 11 toward the upstream side of the transport route, and a height H3 of the paper ejection opening 22 relative to the paper stand 11 is lower than the height H2 of the paper feed opening 14 relative to the paper stand 11. It can be said that the height H3 corresponds to the distance between the paper stand 11 and the lowest portion of the front wall 24 (the portion connected to the front end 21) and that the height H1 corresponds to the distance between the paper stand 11 and the highest portion (upper end) of the front wall 24. In short, the paper case 20 has a tapered shape on the downstream side. Therefore, when the paper case 20 is mounted on the paper stand 11, the front end 21 with the paper ejection opening 22 is inserted into the main body 12 through the paper feed opening 14. In this case, a portion of the front wall 24 at the end opposite to the front end 21 is positioned outside the main body 12 through the paper feed opening 14.

In this embodiment, when mounted on the paper stand 11 of the scanner 10, the paper case 20 has an inner space surrounded by the side walls 23 and the front wall 24 with the height H1 being greater than the height H2 of the paper feed opening 14. This enables the paper case 20 to accommodate a larger number of paper sheets P than the maximum number of paper sheets P that may be directly placed on the paper stand 11, thereby reducing the burden on the user arising when the transport mechanism transports a large number of paper sheets P to the scanner 10. In FIG. 4A and FIG. 4B, a substantially parallelogram shape denoted by the alternate long and two short dashes line corresponds to (a cross section of) a stack of paper sheets P accommodated in the paper case 20.

As can be seen from FIG. 4A and FIG. 4B, the sloped surface of the front wall 24 is in contact with the downstream side of the paper sheets P so that the front wall 24 can control the locations of the paper sheets P stacked in the paper case 20. As a result, the paper sheets P placed at a lower location (closer to the paper stand 11) are positioned further ahead on the downstream side. This helps the scanner 10 to subsequently take in the paper sheets P into the main body 12 from the bottom by using the separation roller 16 positioned adjacent to the paper feed opening 14. In this case, since the front end 21 with the paper ejection opening 22 is inserted into the main body 12 through the paper feed opening 14, the paper sheets P in the paper case 20 are reliably delivered to the interior of the main body 12 through the paper feed opening 14. After the paper sheets P in the paper case 20 have been delivered to the interior of the main body 12 through the paper feed opening 14, the scanner 10 scans the paper sheets P while transporting the paper sheets P, thereby producing the image data.

By setting the upper cover 26 to the open state as illustrated in FIG. 4B, a user can insert a larger number of paper sheets P into the paper case 20 than when the upper cover 26 is in the closed state. As described above, the upper cover 26 is provided with the side covers 26*a*. Therefore, even when the paper sheets P are stacked in the paper case 20 with the upper cover 26 being in the open state such that some of the paper sheets P are positioned beyond the upper ends of the side walls 23, the side cover 26*a* controls the locations of these paper sheets P positioned beyond the upper ends of the side walls 23, thereby reducing the risk of the paper sheet P falling from the paper case 20.

As illustrated in FIG. 2A, FIG. 2B, FIG. 4A, and FIG. 4B, the paper case 20 may have an angled end 27*a* at the rear end of the bottom 27; the angled end 27*a* extends downward from the bottom 27. As illustrated in FIG. 4A and FIG. 4B, when the paper case 20 is mounted on the paper stand 11, the angled end 27*a* engages with the upper end ha of the paper stand 11 (the end of the paper stand 11 on the upstream side). The engagement between the angled end 27*a* and the paper stand 11 determines a location of the paper case 20 on the paper stand 11 in a transport direction. The angled end 27*a* is an exemplary positioning mechanism that fixes the paper case 20 mounted on the paper stand 11 by bringing its upstream side into contact with the scanner 10 (the transport apparatus). However, the positioning mechanism is not limited to the angled end 27*a*. Any given positioning mechanism that can fix the paper case 20 in the transport direction may be used.

Other embodiments of the invention will be described below. Obviously, a combination of such embodiments should fall within the scope disclosed in the invention. Hereinafter, constituent elements, functions, features, and the like similar to those described above will not be described again.

Second Embodiment

Figure 5:
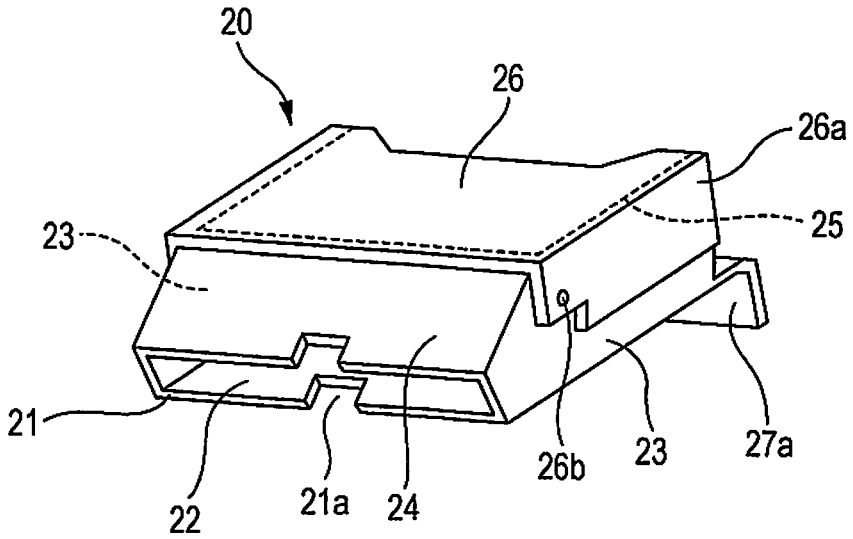
FIG. 5 is a perspective view of a paper case in a second embodiment.

When a paper sheet sensor 17 used to detect the presence of a paper sheet is provided in a scanner 10 adjacent to a paper feed opening 14, the paper case 20 may be provided with a recess 21*a* at the front end 21. The recess 21*a* creates a clearance for the paper sheet sensor 17 when the paper case 20 is mounted on the paper stand 11, in order to prevent the front end 21 from making contact with the paper sheet sensor 17. FIG. 5 illustrates the paper case 20 in a second embodiment in perspective view, more specifically the exterior of the paper case 20 as seen from the same viewpoint as in FIG. 2B. In the second embodiment, the paper case 20 is provided with the recess 21*a* in substantially the middle of the front end 21. This recess 21*a* is a notch formed such that the periphery of the front end 21 surrounds the paper sheet sensor 17 of the scanner 10 when the paper case 20 is mounted on the paper stand 11.

The paper sheet sensor 17 may be provided, for example adjacent to the paper feed opening 14, more specifically at a sensor location SP denoted by the broken line arrow in FIG. 3A. The paper sheet sensor 17 includes at least a projection protruding toward the center of the paper feed opening 14 when no paper sheets are present on the paper stand 11. This projection pivots (retracts) due to the weight of the paper sheet when making contact with the downstream side of a paper sheet placed on a paper stand 11. In FIG. 4A and FIG. 4B, the projection of the paper sheet sensor 17, which is denoted by the broken line, pivots (or retracts) by making contact with paper sheets P accommodated in the paper case 20. In this case, the paper sheet sensor 17 detects that a paper sheet is present on the paper stand 11 in response to the pivoting (or retraction) of the projection.

When the paper sheet sensor 17 configured above is used, if the recess 21*a* is not formed in the paper case 20 at the front end 21, the paper sheet sensor 17 may detect the presence of a paper sheet although no paper sheets are accommodated in the paper case 20. This is because the front end 21 might keep contact with the paper sheet sensor 17 from the time when the paper case 20 has been mounted on the paper stand 11. In the second embodiment, forming the recess 21*a* can reduce the risk of the paper sheet sensor 17 making contact with the paper case 20 when the paper case 20 accommodating no paper sheets is mounted on the paper stand 11. When the paper case 20 accommodating a paper sheet is mounted on the paper stand 11, the paper sheet sensor 17 can reliably make contact with the downstream side of the paper sheet which has been transported from the paper case 20 through the paper ejection opening 22. Consequently, it is possible to reduce the risk of the paper sheet sensor 17 falsely detecting the presence of a paper sheet.

Third Embodiment

Figure 6A:
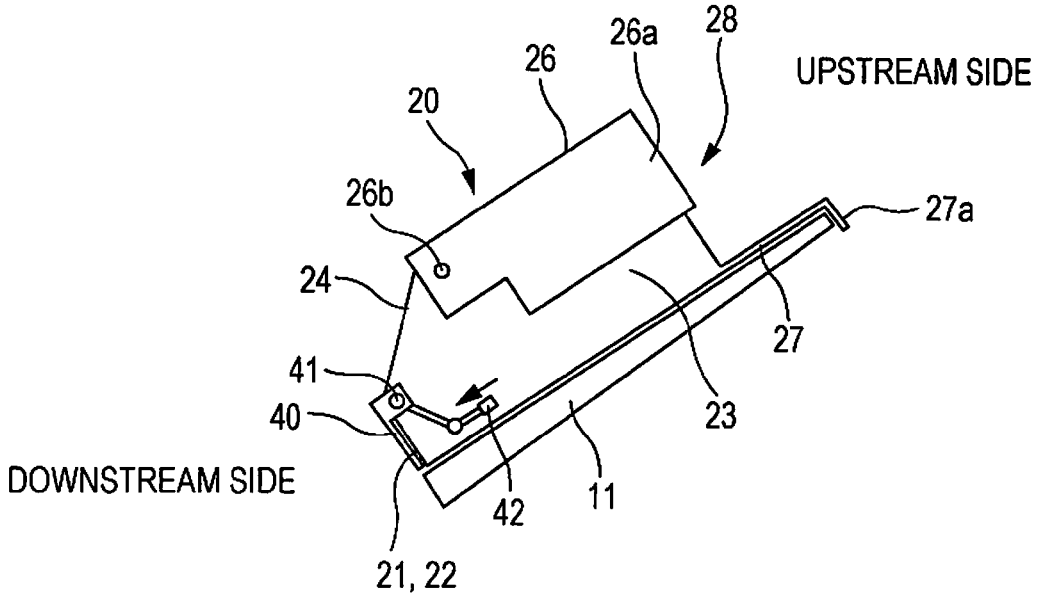
FIG. 6A is a side view of a paper case in a third embodiment.
Figure 6B:
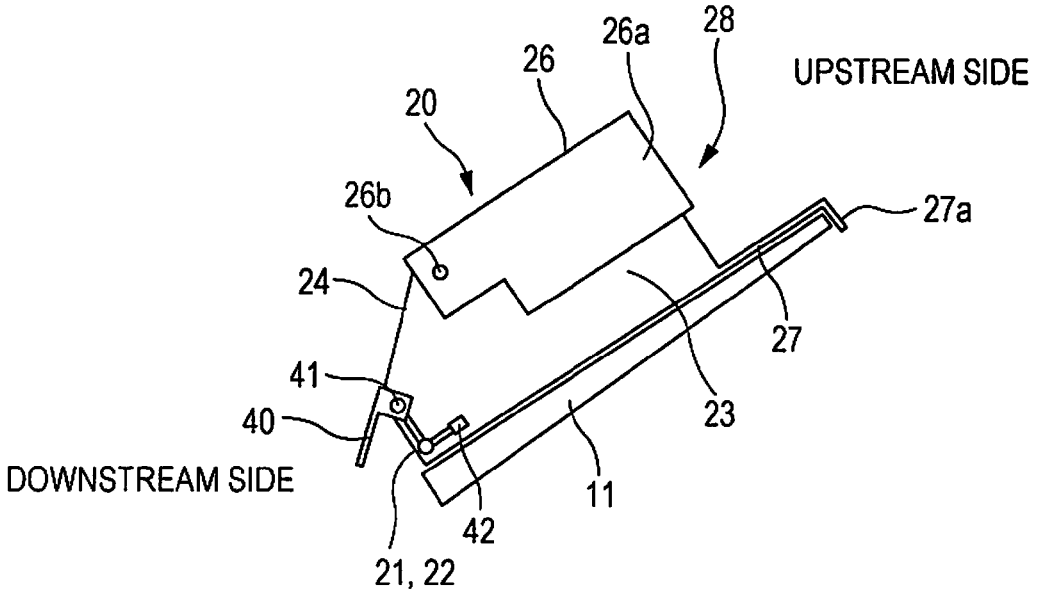
FIG. 6B is another side view of the paper case in the third embodiment.

A paper case 20 may have a front cover 40, which at least partly closes a paper ejection opening 22. FIG. 6A illustrates the paper case 20 provided with the front cover 40 as seen from the same viewpoint as in FIG. 4A; FIG. 6B illustrates the paper case 20 provided with the front cover 40 as seen from the same viewpoint as in FIG. 4B. However, each of FIG. 6A and FIG. 6B illustrates the exterior of the paper case 20 instead of the cross section. FIG. 6A illustrates the front cover 40 in a closed state; FIG. 6B illustrates the front cover 40 in an open state. The front cover 40 may be any member that can suppress paper sheets accommodated in the paper case 20 from being ejected therefrom through a paper ejection opening 22 while being in the closed state. Thus, the front cover 40 may cover either the whole or a part of the paper ejection opening 22.

As illustrated in FIG. 6A and FIG. 6B, the front cover 40 is supported on side walls 23 by a shaft 41 in the vicinity of the connecting location of a front wall 24 and a front end 21. The front cover 40 is indirectly connected to a switch 42 to be operated by a user and is rotatable around the shaft 41 in accordance with a user's operation with the switch 42. When the front cover 40 is in the closed state, for example, the user can set the front cover 40 in the open state (see FIG. 6B) by sliding the switch 42 in the direction of the straight arrow in FIG. 6A. In addition, the user can switch the front cover 40 from the open state to the closed state by sliding the switch 42 in the reverse direction.

In the third embodiment described above, the user inserts paper sheets into the paper case 20 with the front cover 40 being in the closed state. Then, the user mounts the paper case 20 accommodating the paper sheets on the paper stand 11, and switches the front cover 40 to the open state. In this way, the user can reduce the risk of the paper sheets falling from the paper case 20 through the paper ejection opening 22 before mounting the paper case 20 on the paper stand 11. A specific structure of the front cover 40 is not limited to the structure illustrated in FIG. 6A and FIG. 6B. More specifically, the front cover 40 does not necessarily have to open the lower portion of the paper case 20 by rotating around a shaft positioned close to the upper end of the paper case 20. Alternatively, as opposed to the structure in FIG. 6A and FIG. 6B, the front cover 40 may open an upper portion of the paper case 20 by rotating around a shaft positioned close to a lower end of the paper case 20.

Fourth Embodiment

Figure 7:
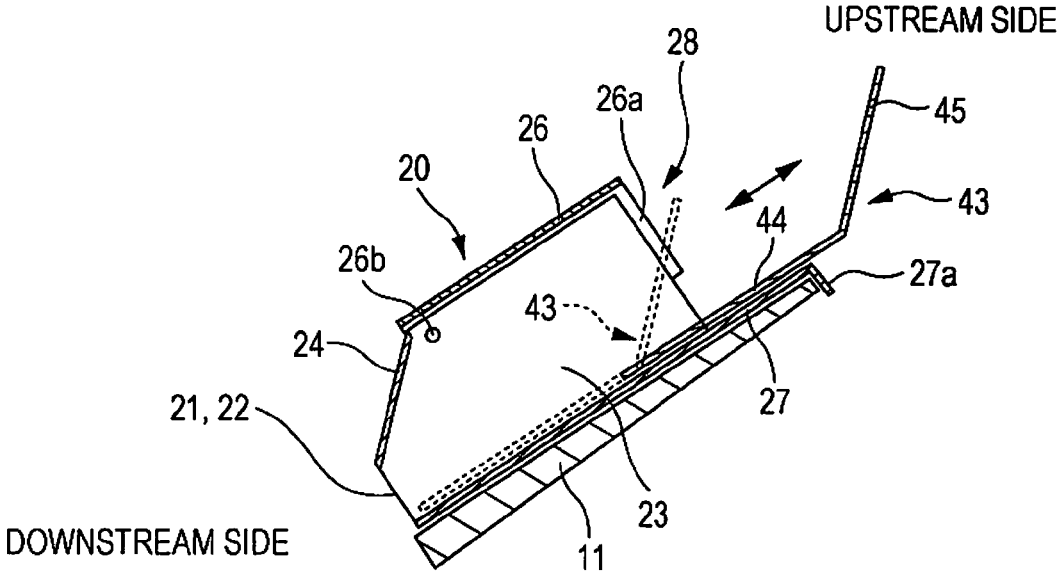
FIG. 7 is a cross-sectional view of a paper case in a fourth embodiment.

A paper case 20 may have a rear wall 45, which is positioned upstream of the front wall 24 when the paper case 20 is mounted on a paper stand 11. The rear wall 45 slopes up from the paper stand 11 toward the upstream side. FIG. 7 is a cross-sectional view of the paper case 20 provided with a pullout section 43 as seen from the same viewpoint as in FIG. 4A and FIG. 4B. When the paper case 20 is not used, the whole or a part of the pullout section 43 may be retracted into the paper case 20. When the paper case 20 is used, the user may pull out the pullout section 43 from the paper case 20 toward the rear side through a rear opening 28.

In FIG. 7, the pullout section 43 retracted into the paper case 20 is denoted by the broken line, whereas the pullout section 43 pulled out from the paper case 20 is denoted by the solid line. The components of the pullout section 43 are the rear wall 45 and a bottom plate 44 connected to the lower end of the rear wall 45. The bottom plate 44 is a sheet-shaped member slidably disposed over a bottom 27. The sloped portion of the rear wall 45 extends parallel to the front wall 24. The term "parallel" discussed herein does not mean exactly parallel, so it may contain some error that would be generated during an actual manufacturing process.

When the user inserts paper sheets into the paper case 20 with the pullout section 43 being pulled out, the user may bring the upstream side of the paper sheets into contact with the rear wall 45. The location of the paper sheets stacked in the paper case 20 is thereby controlled by both the front wall 24 and the rear wall 45. In this case, the downstream side of the paper sheets stacked in the paper case 20 slopes at substantially the same angle as the front wall 24, whereas the upstream side of the paper sheets slopes at substantially the same angle as the rear wall 45. As a result, in the paper case 20, the stack of paper sheets disposed at a lower location are kept being positioned further ahead on the downstream side. This can help the ADF to perform a process of sequentially transporting the paper sheets from the bottom.

The rear wall 45 may continuously slop up from the bottom plate 44 at a preset angle, as illustrated in FIG. 7. Alternatively, when the paper case 20 is not used, the rear wall 45 may be folded so as to be parallel to the bottom plate 44. In this case, when the paper case 20 is used, the user may pull out the pullout section 43 and then may place the rear wall 45 at a preset angle with respect to the bottom plate 44, as illustrated in FIG. 7.

Fifth Embodiment

In a paper case 20, at least a portion of the inner surface of each side wall 23, the inner surface of a front wall 24, and the inner surface of a bottom 27 may have a lower frictional coefficient than the outer surface of each side wall 23, the outer surface of the front wall 24, and the outer surface of the bottom 27. The above inner surfaces face the center of the inner space of the paper case 20, whereas the above outer surfaces face the outside of the paper case 20. There are two main methods of decreasing the frictional coefficient of each inner surface. In the first method, a material having a lower frictional coefficient than the material for the paper case 20, or a low-friction material, is disposed inside the paper case 20. In the second method, the inner surface of the paper case 20 which make contact with a paper sheet accommodated therein is decreased in area. For example, small projections and depressions may be formed over the inner surface of the paper case 20. The paper sheet thereby makes point contact with the inner surface of the paper case 20, which decreases a friction generated between the paper sheet and the inner surface of the paper case 20.

Figure 8:
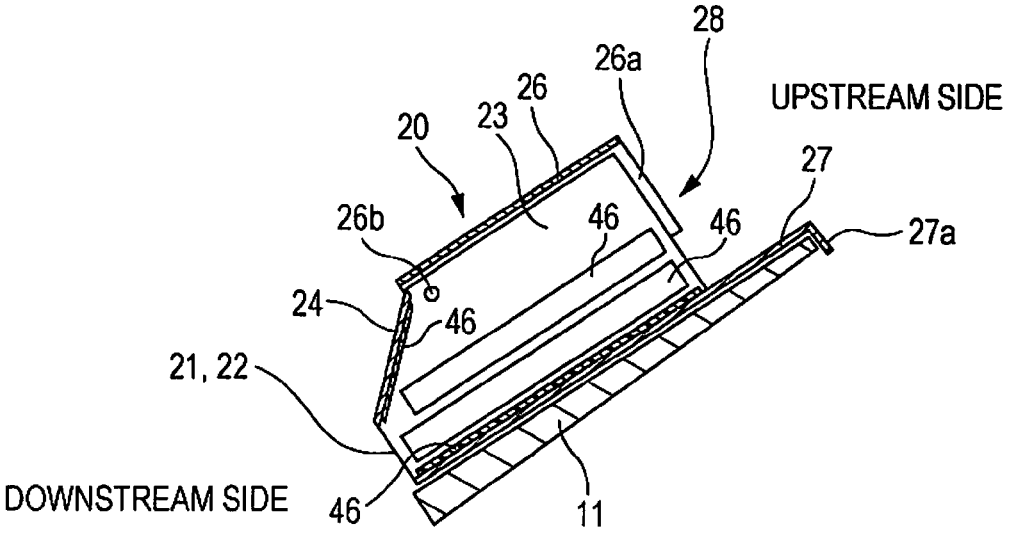
FIG. 8 is a cross-sectional view of a paper case in a fifth embodiment.

FIG. 8 is a cross-sectional view of a paper case 20, which is an example of the fifth embodiment described above, as seen from the same viewpoint as in FIG. 4A and FIG. 4B. As illustrated in FIG. 8, a tape 46 made of a low-friction material is bonded to the inner surface of each side wall 23, the inner surface of a front wall 24, and the inner surface of a bottom 27 in the paper case 20. This low-friction material is preferably a synthetic resin, especially a PTFE (fluoroplastics) film in terms of its low frictional coefficient. Obviously, the tape 46 may also be bonded to the inner surface of an upper cover 26. If the paper case 20 has a pullout section 43 (see FIG. 7), the tape 46 may also be bonded to the inner surface of a bottom plate 44 and the inner surface of a rear wall 45. In the fifth embodiment described above, by decreasing a friction between the inner surface of the paper case 20 and a paper sheet, the paper sheet can be ejected smoothly from the interior of the paper case 20 to the outside through the paper ejection opening 22.

Sixth Embodiment

Figure 9:
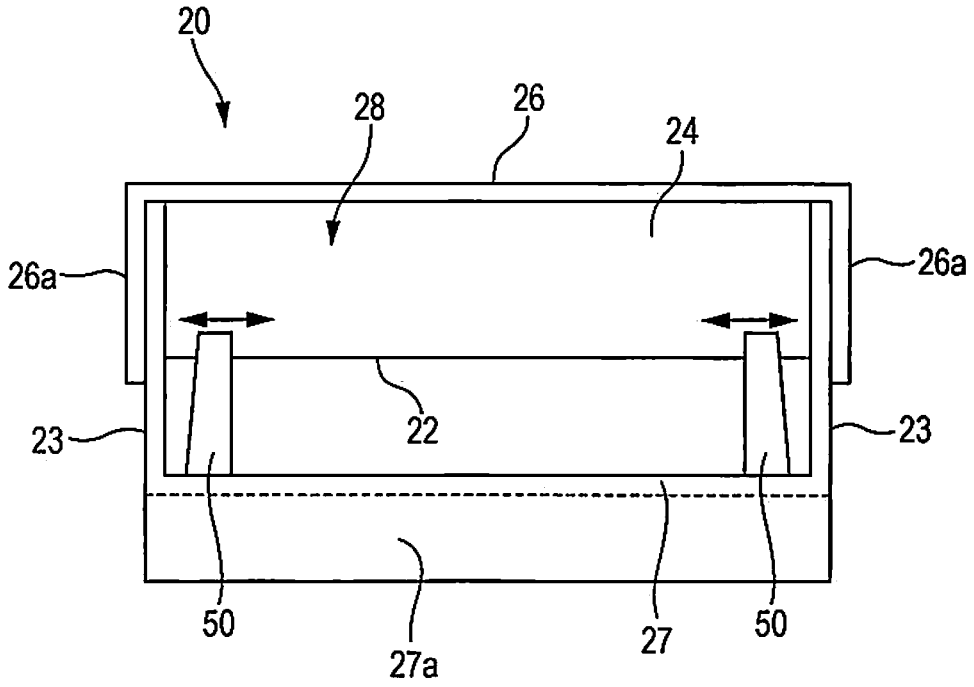
FIG. 9 is a rear view of a paper case in a sixth embodiment.

A paper case 20 may have a pair of movable walls 50 therein, which are movable between side walls 23. FIG. 9 illustrates the paper case 20 provided with the movable walls 50 as seen from its rear side, or as seen from the side on which a rear opening 28 is formed. The movable walls (sliders) 50 are erected from the inner surface of a bottom 27 in the paper case 20. The movable walls 50 have substantially the same mechanism as the paper stand movable walls 13 and can move between the side walls 23 in the width directions while the paper case 20 is mounted on a paper stand 11. The paper case 20 may support paper sheets having various sizes (e.g., an L size and a KG size). A user can control the location of the paper sheets within the paper case 20 in a width direction by varying a distance between the movable walls 50 to bring the movable walls 50 into contact with both lateral sides of the paper sheets.

If the paper case 20 has a pullout section 43 (see FIG. 7), the movable walls 50 may be erected from the inner surface of a bottom plate 44, instead of from the inner surface of the bottom 27. Alternatively, the movable walls 50 may be formed on the upper cover 26 while protruding downward from the inner surface of the upper cover 26.

Other Embodiments

When a paper case 20 is mounted on a paper stand 11, a front end 21 does not necessarily have to be inserted into a main body 12 through a paper feed opening 14. As an example, a height H3 of a paper ejection opening 22 relative to the paper stand 11 may be slightly greater than a height H2 of the paper feed opening 14 relative to the paper stand 11. As another example, when the paper case 20 is mounted on the paper stand 11, the paper ejection opening 22 may be positioned upstream of the paper feed opening 14.

An upper cover 26 of the paper case 20 does not necessarily have to be opened. In other words, the upper cover 26 may be a sheet-shaped member that continuously covers the upper opening 25. Alternatively, the paper case 20 may be removed from the upper cover 26.

The article denoted by the reference numeral 20 is named a "paper case", because representative examples of products accommodated in this article 20 include various types of papers, such as plant-based papers, animal-based papers, and paper resins. However, other products, including ID cards, fabric sheets, and leather sheets, may be accommodated in the paper case 20. In other words, the paper case 20 can accommodate arbitrary sheet media that a transport apparatus, such as a scanner, a printer, or a cutting machine, can transport. Thus, the article denoted by the reference numeral 20 may be named not only the paper case but also a medium case, a sheet case, a medium holder, a sheet holder or others.

What is claimed is:

1. A paper case that is configured to accommodate a paper sheet, the paper case being configured to be installed in a transport apparatus, the transport apparatus having a transport mechanism that transports a paper sheet placed on a paper stand from a paper feed opening to a downstream side of a transport route, the paper case, when mounted on the paper stand, the paper case comprising:

a paper ejection opening positioned at a front end facing the downstream side;

a plurality of side walls positioned on a first side and a second side in a direction intersecting the transport route, a height of each side wall relative to the paper stand being greater than a height of the paper feed opening relative to the paper stand;

a front wall continuing from the front end, the front wall sloping so that a height of the front wall relative to the paper stand increases toward an upstream side of the transport route; and a recess, when the paper case is mounted on the paper stand, the recess creating a clearance for a sensor disposed adjacent to the paper feed opening, the sensor being used to detect whether the paper sheet is present.

2. The paper case according to claim 1, wherein when the paper case is mounted on the paper stand, a height of the paper ejection opening relative to the paper stand is lower than the height of the paper feed opening relative to the paper stand and the front end is inserted into the transport apparatus through the paper feed opening.

3. The paper case according to claim 1, further comprising an upper cover that is switched between a closed state and an open state, wherein in the closed state, the upper cover closes an upper opening defined by upper ends of the side walls on the first side and the second side and an upper end of the front wall, and in the open state, the upper cover moves upward from the upper opening to open the upper opening.

4. The paper case according to claim 1, further comprising a positioning mechanism that, when the paper case is mounted on the paper stand, positions the paper case by making contact with the transport apparatus on the upstream side.

5. The paper case according to claim 1, wherein at least a portion of inner surfaces of the side walls on the first side and the second side, an inner surface of the front wall, and an inner surface of a bottom that makes contact with the paper stand on which the paper case is mounted has a lower frictional coefficient than outer surfaces of the side walls, an outer surface of the front wall, and an outer surface of the bottom.

6. The paper case according to claim 1, further comprising a front cover that is configured to at least partly open or close the paper ejection opening.

7. The paper case according to claim 1, further comprising a rear wall positioned on the upstream side relative to the front wall when the paper case is mounted on the paper stand, the rear wall sloping so that a height of the rear wall relative to the paper stand increases toward the upstream side.

8. The paper case according to claim 1, further comprising a movable wall disposed therein, the movable wall being movable between the side walls on the first side and the second side.

9. The paper case according to claim 1, further comprising a bottom portion connecting the side walls, the side walls extending from the bottom portion in a first direction, and a positioning portion configured to position the paper case relative to the paper stand, and extending from the bottom portion in a second direction opposite the first direction.

10. A paper feed system comprising:

a transport apparatus having a transport mechanism and a sensor, the transport mechanism transporting a paper sheet placed on a paper stand from a paper feed opening to a downstream side of a transport route, the sensor being disposed adjacent to the paper feed opening and used to detect whether the paper sheet is present; and a paper case that is configured to accommodate the paper sheet, the paper case, when mounted on the paper stand, including, a paper ejection opening positioned at a front end facing the downstream side, a plurality of side walls positioned on a first side and a second side in a direction intersecting the transport route, a height of each side wall relative to the paper stand being greater than a height of the paper feed opening relative to the paper stand, a front wall continuing from the front end, the front wall sloping so that a height of the front wall relative to the paper stand increases toward the upstream side of the transport route, and a recess creating a clearance for the sensor when the paper case is mounted on the paper stand.

11. A method of producing a product by using a paper case, the paper case, when mounted on a paper stand, including a paper ejection opening positioned at a front end facing a downstream side, a plurality of side walls positioned on a first side and a second side in a direction intersecting a transport route, a height of each side wall relative to the paper stand being greater than a height of the paper feed opening relative to the paper stand, a front wall continuing from the front end and sloping so that the height of each side wall relative to the paper stand increases toward an upstream side of the transport route, and a recess creating a clearance for a sensor disposed adjacent to the paper feed opening when the caper case is mounted on the paper stand, the sensor being used to detect whether the paper sheet is present, the method comprising:

guiding, along the front wall, a stack of paper sheets placed in the paper case between the side walls to a paper ejection opening below the front wall;

transporting the guided paper sheets; and processing the transported paper sheets to produce a product.

* * * * *